US009358671B2

(12) United States Patent
Lin

(10) Patent No.: US 9,358,671 B2
(45) Date of Patent: Jun. 7, 2016

(54) HAND TOOL WITH LATCH STRUCTURE

(71) Applicant: Yih Cheng Factory Co., Ltd., Nantuo (TW)

(72) Inventor: Jack Lin, Nantuo (TW)

(73) Assignee: YIH CHENG FACTORY CO., LTD, Nantuo (TW)

( * ) Notice: Subject to any disclaimer, the term of this patent is extended or adjusted under 35 U.S.C. 154(b) by 256 days.

(21) Appl. No.: 14/287,810

(22) Filed: May 27, 2014

(65) Prior Publication Data

US 2015/0343619 A1 Dec. 3, 2015

(51) Int. Cl.
*B25B 23/00* (2006.01)
*B25B 15/02* (2006.01)

(52) U.S. Cl.
CPC ..... *B25B 23/0035* (2013.01); *B25B 15/02* (2013.01); *B25B 23/0042* (2013.01)

(58) Field of Classification Search
CPC ..... B25B 15/02; B25B 23/0042
USPC ..... 81/438, 125, 436
See application file for complete search history.

(56) References Cited

U.S. PATENT DOCUMENTS 2,596,594 A * 5/1952 Petre ..... B25B 23/0042 279/79
4,517,864 A * 5/1985 Fratta ..... H01R 43/22 81/436
5,481,949 A * 1/1996 Yen ..... B25B 23/0035 279/24
5,881,614 A * 3/1999 Cheng-Tsan ..... B25B 23/0042 279/102
5,954,463 A * 9/1999 Jore ..... B23B 31/1071 408/239 R
6,840,143 B1 * 1/2005 Lin ..... B25B 23/0035 81/177.85
7,458,296 B2 * 12/2008 Richter ..... B25B 15/02 81/177.2
7,467,575 B2 * 12/2008 Lai ..... B25B 15/02 81/177.1
7,717,016 B2 * 5/2010 Lai ..... B25B 23/0042 81/177.1
2007/0044596 A1 * 3/2007 Chen ..... B25B 23/0035 81/125
2009/0293687 A1 * 12/2009 Nino ..... B25B 23/1427 81/476

* cited by examiner

*Primary Examiner* — Hadi Shakeri
*Assistant Examiner* — Danny Hong
(74) *Attorney, Agent, or Firm* — Chun-Ming Shih; HDLS IPR Services

(57) ABSTRACT

A hand tool with a latch structure includes a main body (10) and a latch unit (20) coupled to the main body (10), and the latch unit (20) includes a rod body (21) and an elastic element (22). The rod body (21) has a center hole (211) formed in an axial direction parallel to the rod body (21) and a through hole (213) formed in an axial direction perpendicular to the rod body (21) and communicated with the center hole (211). The elastic element (22) has a circular plate (221) and a tongue (222) formed by bending from an end of circular plate (221), and the circular plate (221) is clamped outside the rod body (21), and the tongue (222) passes through the through hole (213) into the center hole (211) to achieve the effects of an easy installation and a secured latch.

8 Claims, 9 Drawing Sheets

HAND TOOL WITH LATCH STRUCTURE

FIELD OF THE INVENTION

The present invention relates to a hand tool, and more particularly to the hand tool with a latch structure.

BACKGROUND OF THE INVENTION

In general, a conventional screwdriver combines a rod body with a handle to provide a rotational combination of a locking and positioning component such as a screw. To take the convenience of use into consideration, various types of detachable screwdrivers were developed, so that screwdriver heads of different specifications and shapes can be switched and used with a single handle to reduce the quantity of hand tools required by technicians significantly.

However, some of the conventional detachable screwdrivers adopt elastic plates and steel balls for a latch structure, and the hand tool with such latch structure has a relatively complicated and difficult assembling process, and the steel balls often fall out during an application. Since it is necessary to install the steel balls in the rod body, therefore the rod body has shortcomings of increasing its wall thickness, diameter and volume. Some other conventional detachable screwdrivers adopt wire spring for the latch structure, and the hand tools with such latch structure have the following shortcoming. The wire spring applies a very small pressure onto the screwdriver head, so that the screwdriver head often falls out during an application. Obviously, the conventional screwdrivers require improvements.

In view of the foregoing drawbacks of the prior art, the inventor of the present invention based on years of experience in the related industry to conduct extensive researches and experiments and provided a feasible solution to overcome the drawbacks of the prior art.

SUMMARY OF THE INVENTION

Therefore, it is a primary objective of the present invention to provide a hand tool with a latch structure, wherein a circular plate is used for clamping and a tongue is used for pressing in order to achieve the effects of an easy installation and a secured latch.

To achieve the aforementioned objective, the present invention provides a hand tool with a latch structure, comprising a main body and a latch unit coupled to the main body, wherein the latch unit includes a rod body and an elastic element, and the rod body has a center hole formed in an axial direction parallel to the rod body and a through hole formed in an axial direction perpendicular to the rod body and communicated with the center hole; and the elastic element has a circular plate and a tongue formed by bending from an end of the circular plate, and the circular plate is clamped outside the rod body, and the tongue is passed from the through hole into the center hole.

The present invention further has the following effects. The elastic element is clamped and fixed onto the rod body, so that a rod body of a small diameter can be selected and used to reduce the volume and lower the material cost. Without increasing the external diameter of the handle, the rod body can be inserted into the handle from both directions, and two screwdriver heads of different sizes can be used to improve the functionality of the screwdriver. The positioning slot not just restricts the axial movement of the circular plate only, but also provides a quick positioning effect in the assembling process. The plate structure of the elastic element has a better rigidity and provides the elastic force required for the clamping by the tongue. The guide slot and positioning pit are provided for facilitating the installation or removal of the screwdriver head and fixing and positioning the screwdriver head stably.

DESCRIPTION OF THE PREFERRED EMBODIMENTS

Figure 1:
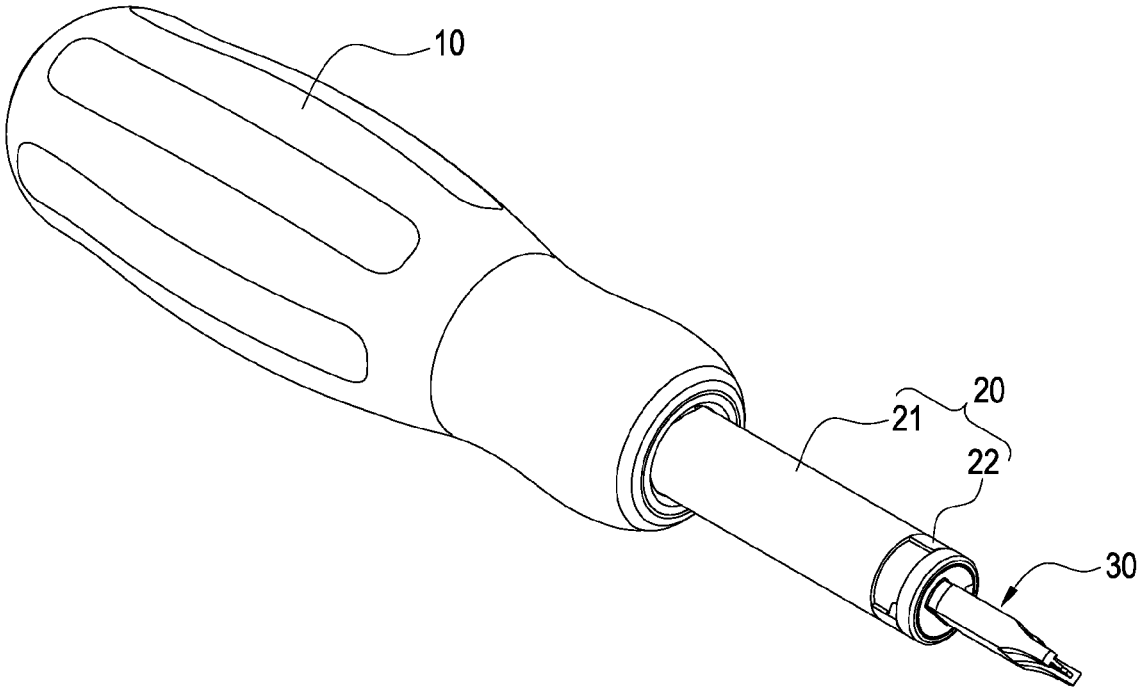
FIG. 1 is a perspective view of a hand tool of the present invention.

The technical contents of the present invention will become apparent with the detailed description of preferred embodiments accompanied with the illustration of related drawings as follows. It is noteworthy that same numerals are used for representing same respective elements in the drawings.

Figure 2:
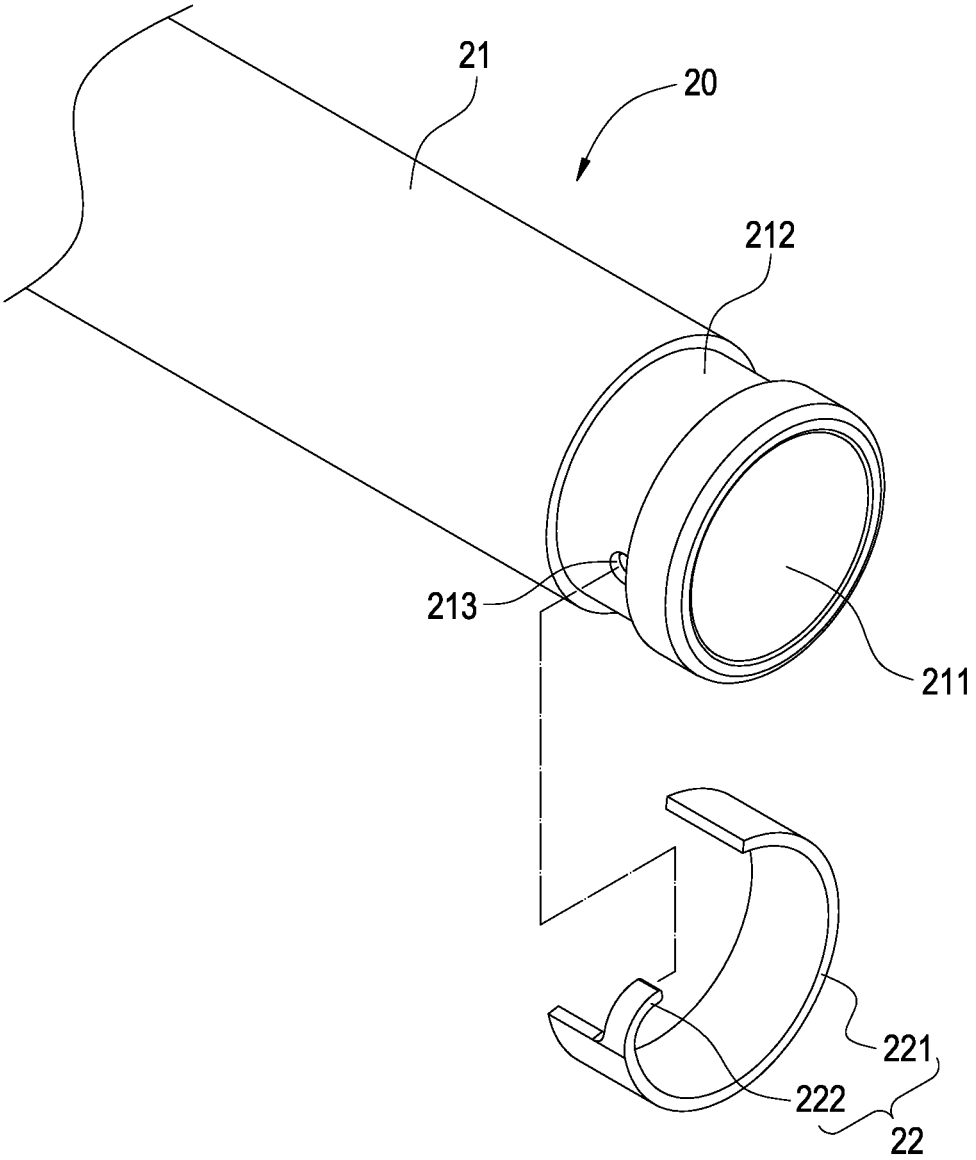
FIG. 2 is an exploded view of a latch unit of the present invention.

With reference to FIGS. 1 and 2 for a hand tool with a latch structure of the present invention, the hand tool of this preferred embodiment is a detachable screwdriver, but the invention is not limited to the detachable screwdriver only. The hand tool comprises a main body 10 and a latch unit 20.

In this preferred embodiment, the main body 10 is a cylindrical handle made of a plastic material and manufactured by molding. However, the main body 10 is not limited to the aforementioned shape and material only, but any light material such as wood or aluminum of other shapes can be used in the invention as well. The main body 10 has a plurality of recesses formed on a surface of the main body 10 to provide friction and an anti-slip effect during the rotation of the screwdriver.

The latch unit 20 includes a rod body 21 and an elastic element 22, wherein the rod body 21 is inserted into an end of the main body 10, and the rod body 21 of this preferred embodiment is a hollow bar-shaped pipe and has a center hole 211 formed in an axial direction parallel to the rod body 21, a positioning slot 212 formed at an end of the rod body 21 and away from the main body 10, and a through hole 213 formed in the positioning slot 212 and communicated with the center hole 211, and the through hole 213 disposed in an axial direction perpendicular to the rod body 21.

The elastic element 22 is made of a rigid and elastic material such as metal and has a substantially C-shaped circular plate 221, and a tongue 222 formed by bending from an end of the circular plate 221 towards the center of the circular plate 221. During assembling, the of the circular plate 221 of the elastic element 22 is entered from an end of the rod body 21 having the positioning slot 212 and limited by the positioning slot 212, while the tongue 222 is passing from the through hole 213 into the center hole 211 (as shown in FIG. 3).

Figure 3:
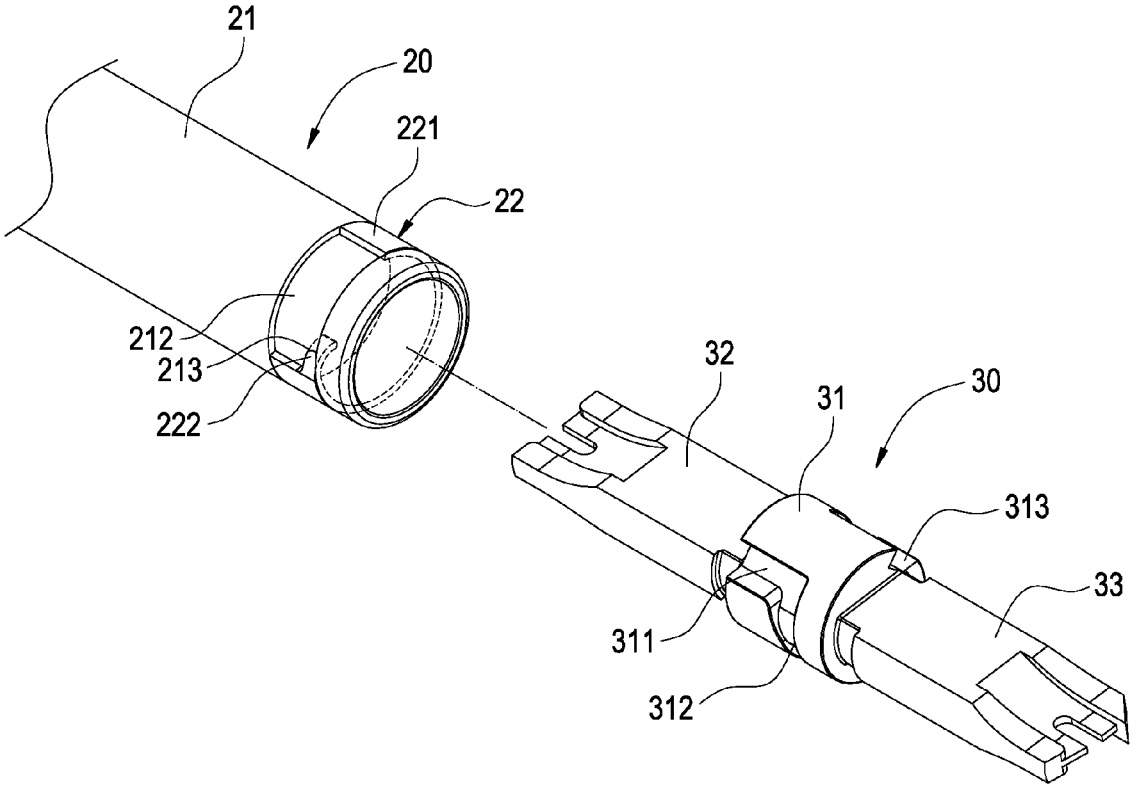
FIG. 3 is an exploded view of a latch unit and a screwdriver head of the present invention.
Figure 4:
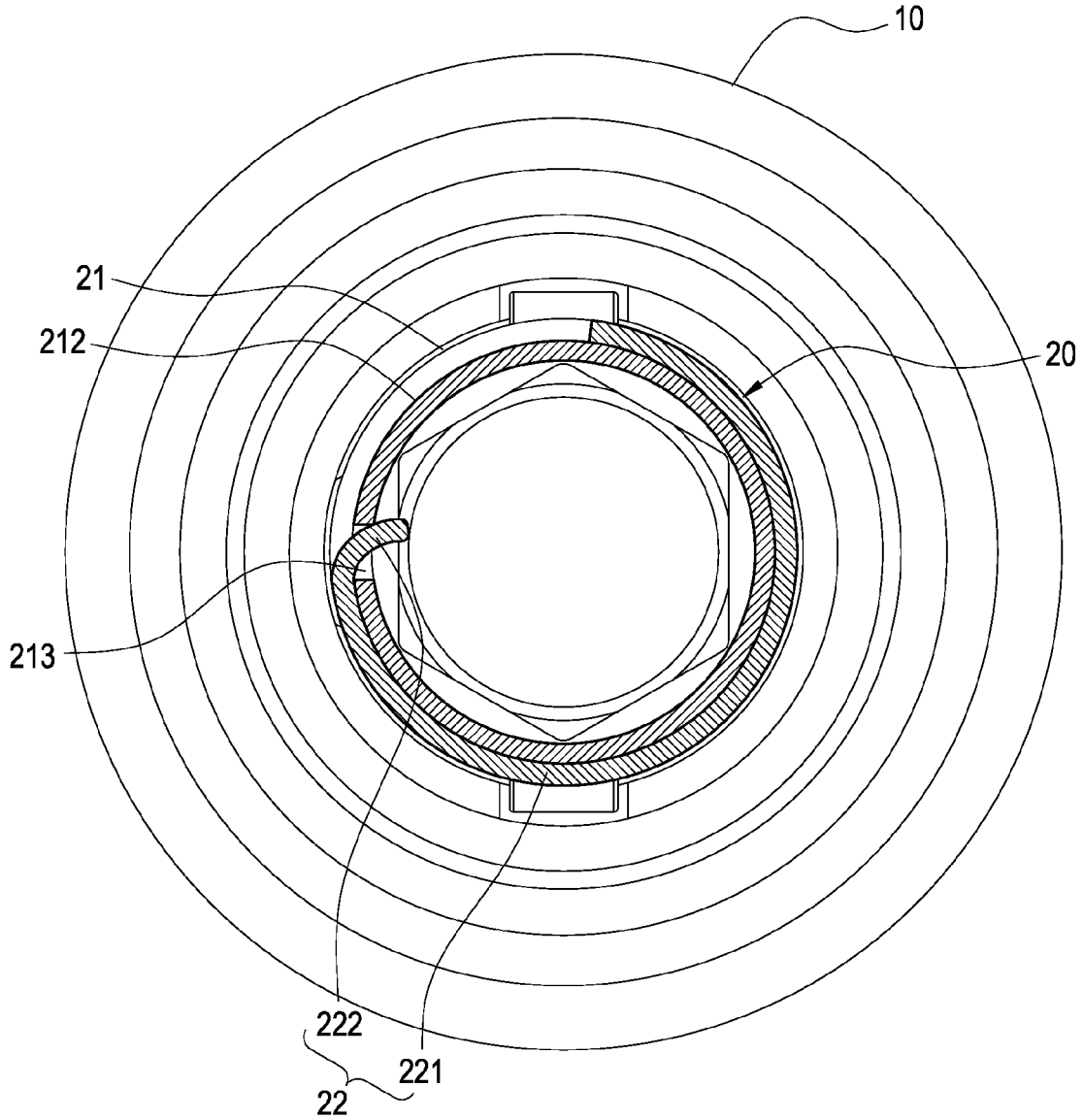
FIG. 4 is a cross-sectional view of assembling a latch unit and a screwdriver head of the present invention.
Figure 7:
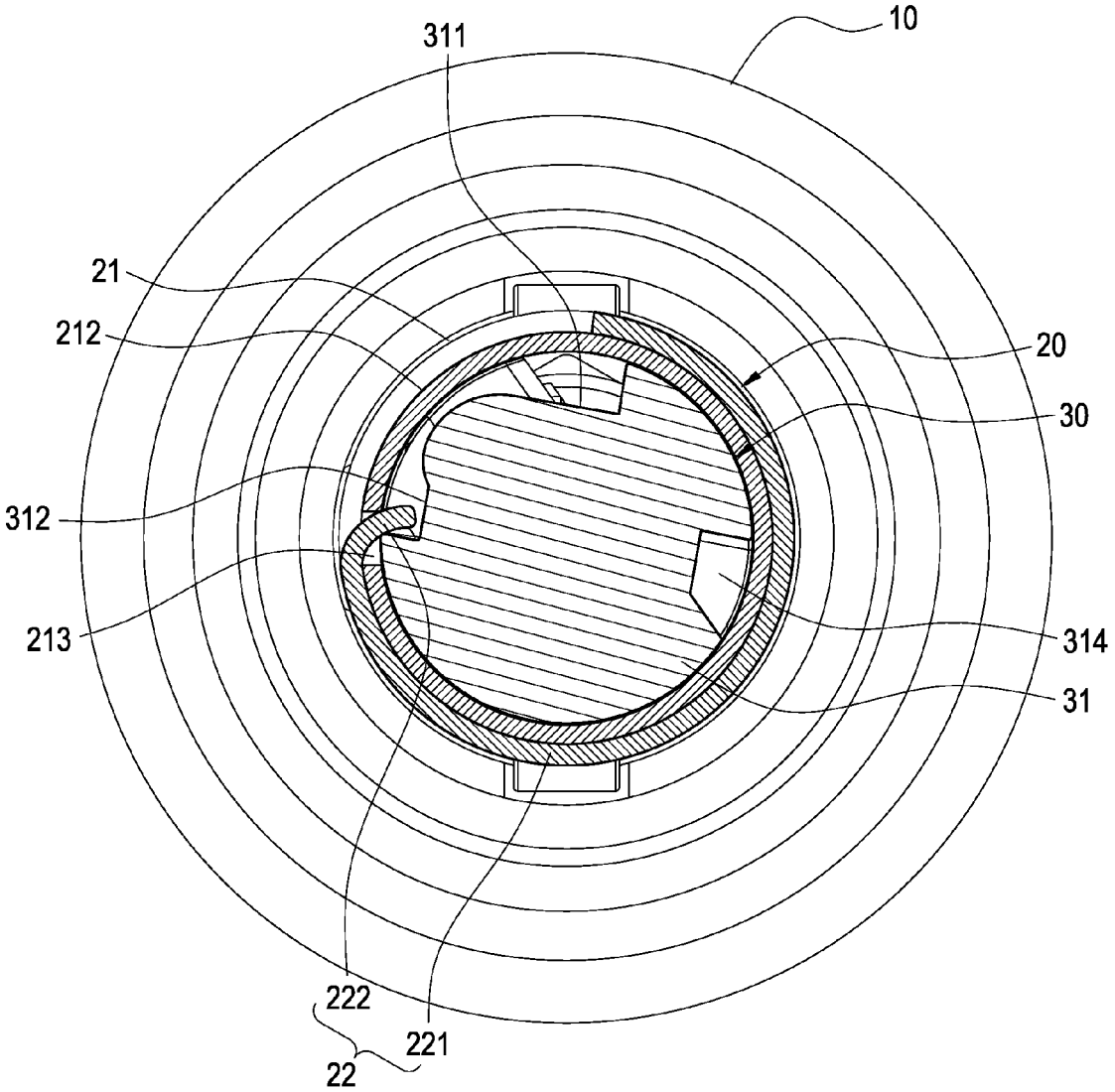
FIG. 7 is a cross-sectional view of FIG. 6.

With reference to FIG. 3 for a hand tool with a latch structure of the present invention, the hand tool further comprises a screwdriver head 30 detachably inserted into the center hole 211 of the rod body 21 and elastically clamped and positioned by the tongue 222. The screwdriver head 30 comprises a clamped section 31, and a first working section 32 and a second working section 33 respectively and axially extended from both ends of the clamped section 31, and the clamped section 31 is a cylindrical body having a first guide slot 311 formed in a direction corresponsive to the first working section 32 and a second guide slot 313 formed in a direction corresponsive to the second working section 33, wherein the first guide slot 311 and the second guide slot 313 are substantially L-shaped, and the first guide slot 311 has a first positioning pit 312 formed at an end of the first guide slot 311, and the second guide slot 313 has a second positioning pit 314 formed at an end of the second guide slot 313 (as shown in FIG. 7).

Figure 5:
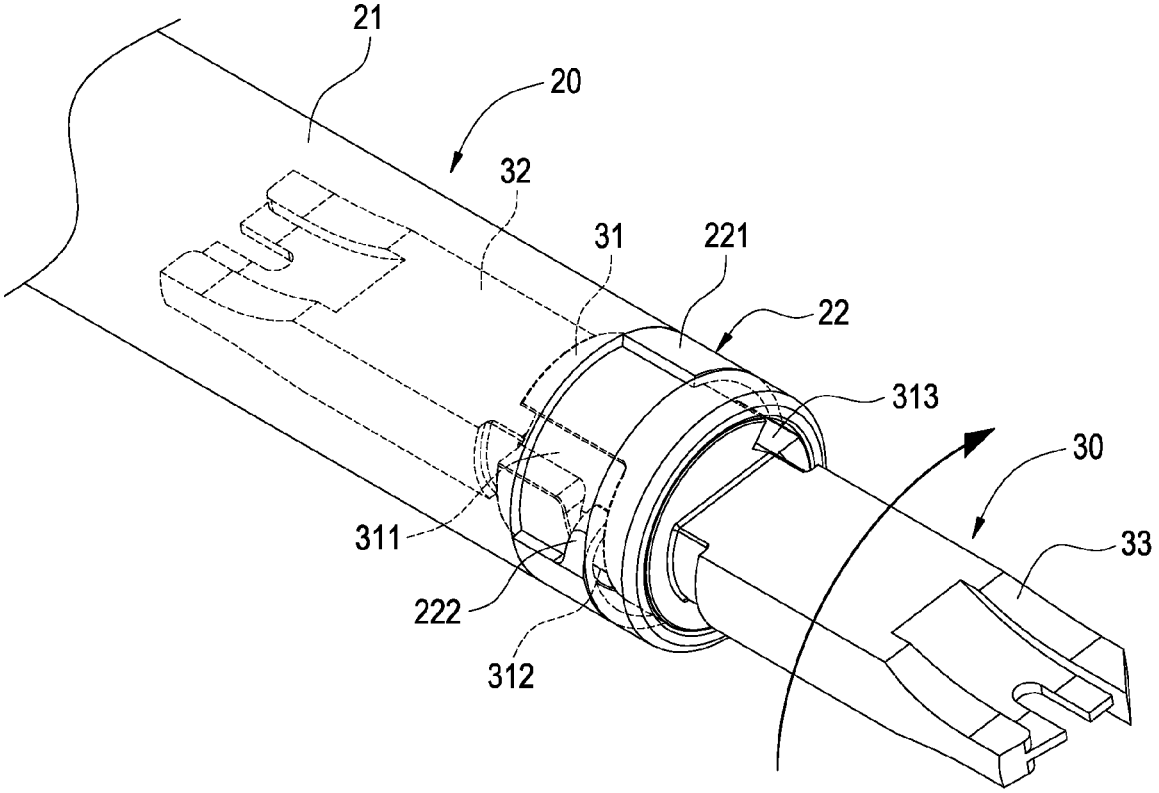
FIG. 5 is a perspective view of a screwdriver head before its being latched by an elastic element in accordance with the present invention.
Figure 6:
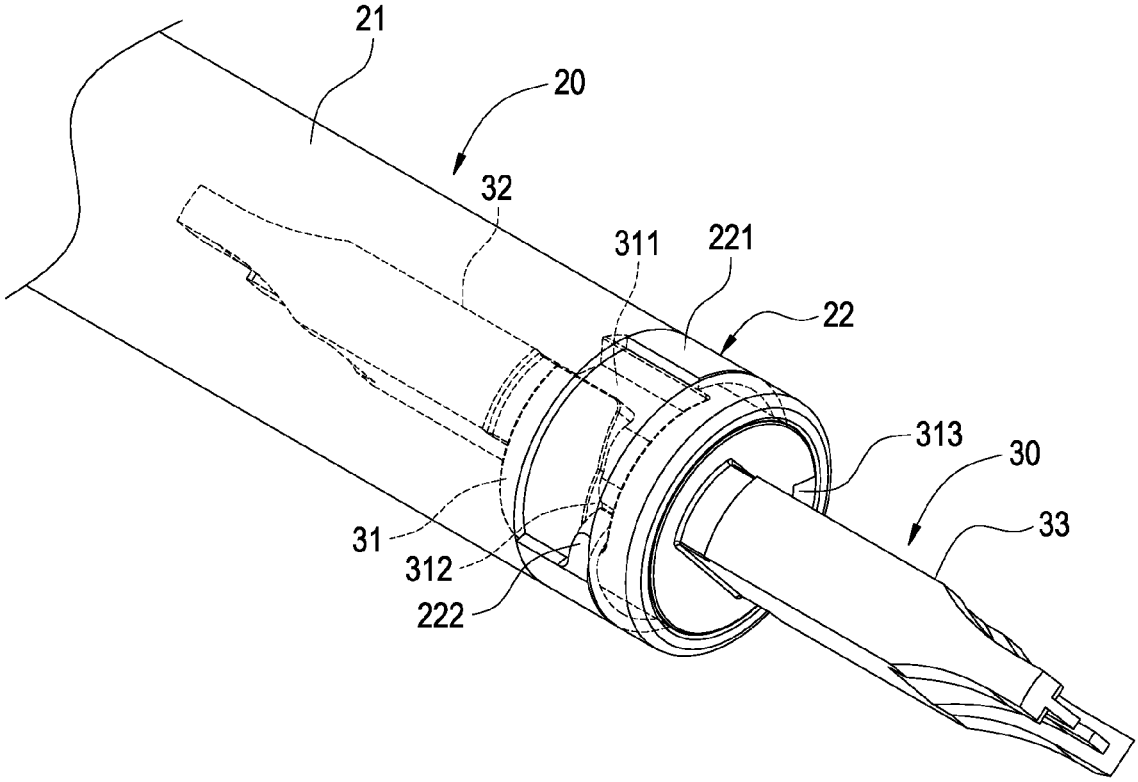
FIG. 6 is a perspective view of a screwdriver head after its being latched by an elastic element in accordance with the present invention.

With reference to FIGS. 4 to 7, the second working section 33 is held by fingers, and the first working section 32 is inserted into the center hole 211 of the rod body 21 for the use of the screwdriver. Until the clamped section 31 reaches the position of the tongue 222 of the elastic element 22, the first guide slot 311 is aligned precisely with the tongue 222 and then pushed, such that when the tongue 222 is stopped by the turning corner of the first guide slot 311, the screwdriver head 30 is rotated clockwise (as shown in FIG. 5). Now, an end of the tongue 222 is entered into the first positioning pit 312 and then positioned due to the rotation of the screwdriver head 30.

During operation, the main body 10 is rotated clockwise. Since the screwdriver head 30 has an end of the second working section 33 embedded into a thread of a screw (not shown in the figure). In a rotating process, a cut edge of an end of the first guide slot 311 and a wall of the through hole 213 of the rod body 21 are jointly clamped onto the tongue 222, so that the screwdriver head 30 is driven to produce a clockwise rotation.

Figure 8:
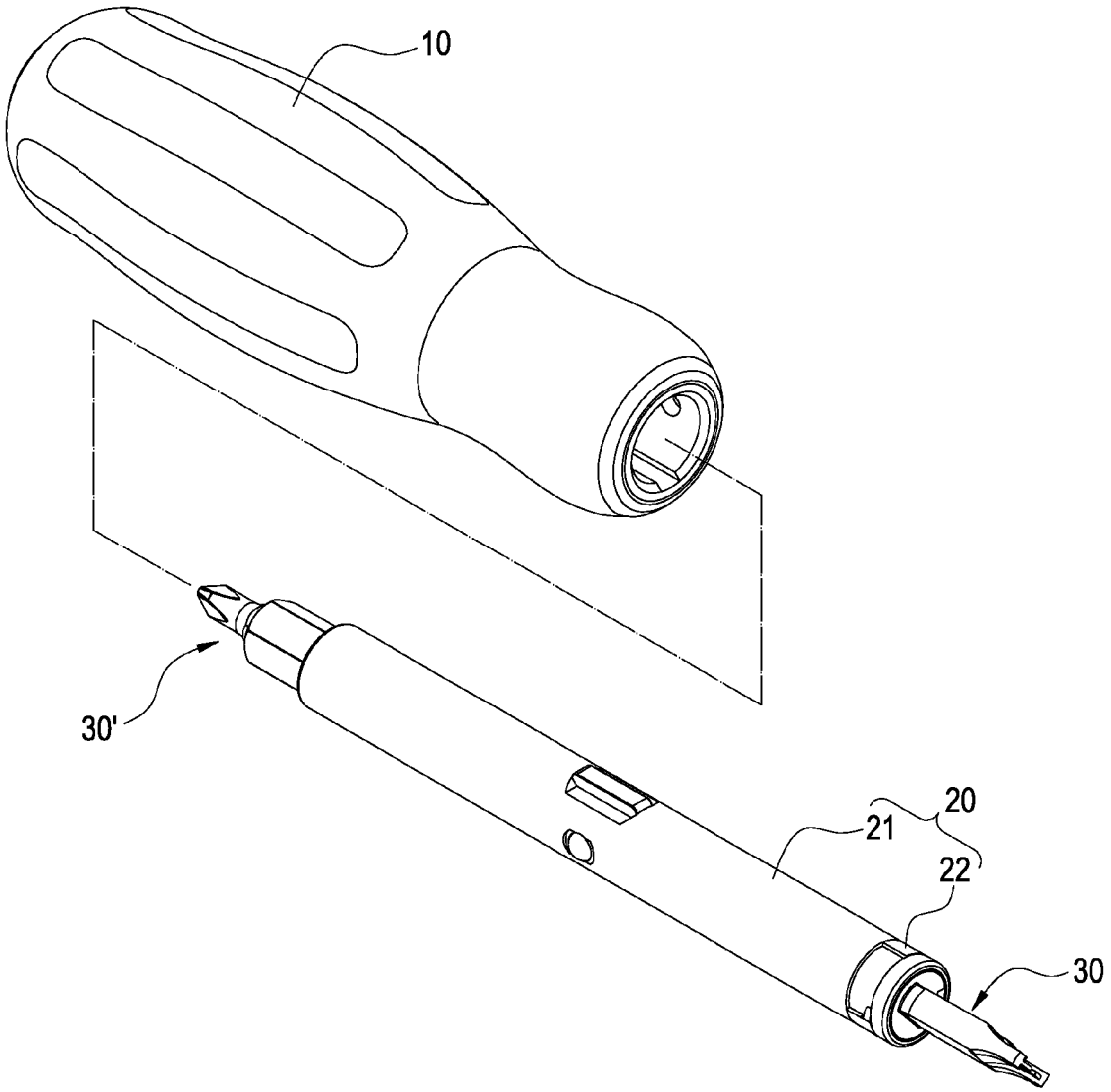
FIG. 8 is an exploded view of a hand tool in accordance with another preferred embodiment of the present invention.
Figure 9:
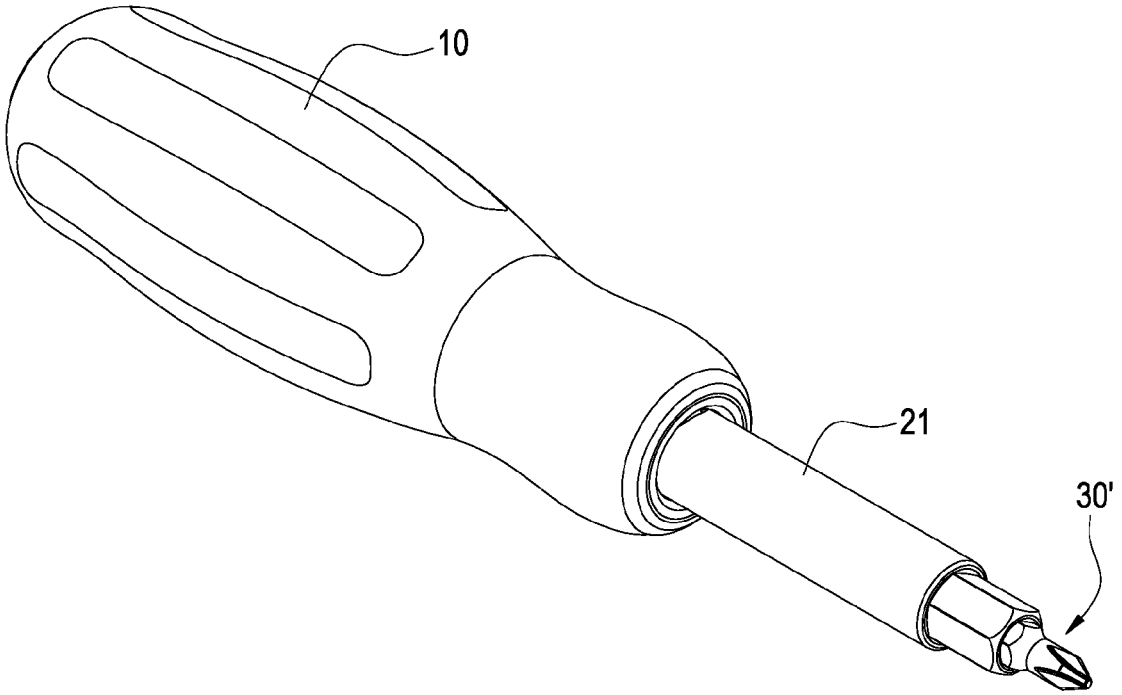
FIG. 9 is a perspective view of a hand tool in accordance with another preferred embodiment of the present invention.

With reference to FIGS. 8 and 9 for a hand tool with a latch structure in accordance with another preferred embodiment of the present invention, the main body 10 and the rod body 21 are detachably coupled with each other, and an end of the rod body 21 is provided for being clamped and coupled by the elastic element 22, and the other end of the rod body 21 is provided for installing and formed as a screwdriver head 30' of another type (such as a Phillips, slotted or hex screwdriver head). During use, the rod body 21 is removed and the direction of the rod body 21 is switched before it is plugged back, and the other end of the rod body 21 is inserted into an insert hole of the main body 10 (as shown in FIG. 9), so as to improve the diversified use of the hand tool.

In summation of the description above, the present invention achieves the expected objectives and overcomes the drawbacks of the prior art, and the invention complies with patent application requirements, and is thus duly filed for patent application.

While the invention has been described by means of specific embodiments, numerous modifications and variations could be made thereto by those skilled in the art without departing from the scope and spirit of the invention set forth in the claims.

What is claimed is:

1. A hand tool with a latch structure, comprising:

a main body (10); a latch unit (20), coupled to the main body (10), and including a rod body (21) and an elastic element (22), and the rod body (21) having a center hole (211) formed in an axial direction parallel to the rod body (21), and a through hole (213) formed in axial direction perpendicular to the rod body (21) and communicated with the center hole (211), and the elastic element (22) having a circular plate (221) and a tongue (222) formed by bending from an end of the circular plate (221), and the circular plate (221) being clamped outside the rod body (21), and the tongue (222) passing from the through hole (213) into the center hole (211);

screwdriver head (30) comprising a clamped section (31) having a cylindrical body with first guide slot (311) formed on the cylindrical body and in a direction corresponsive to the first working section (32) and a second guide slot (313) formed on the cylindrical body and in a direction corresponsive to the second working section (33), wherein the first guide slot (311) further includes a first positioning pit (312) formed at an end of the first guide slot (311) for accommodating the tongue (222), and the second guide slot (313) further includes a second positioning pit (314) formed at an end of the second guide slot (313) for accommodating the tongue (222).

2. The hand tool with a latch structure according to claim 1, wherein the rod body (21) has a positioning slot (212) formed at an end of the rod body (21) that is away from the main body (10), and the circular plate (221) is elastically clamped into the positioning slot (212) of the rod body (21).

3. The hand tool with a latch structure according to claim 1, wherein the circular plate (221) is substantially C-shaped.

4. The hand tool with a latch structure according to claim 3, wherein the tongue (222) is formed by bending from the end of the circular plate (221) towards the center of the circular plate (221).

5. The hand tool with a latch structure according to claim 1, wherein the hand tool is a detachable screwdriver further comprising a screwdriver head (30) detachably inserted into the center hole (211) of the rod body (21).

6. The hand tool with a latch structure according to claim 5, wherein the screwdriver head (30) further comprises a first working section (32) and a second working (33) extended axially and respectively from both ends of the clamped section (31).

7. The hand tool with a latch structure according to claim 1, wherein the first guide slot (311) and the second guide slot (313) are substantially L-shaped.

8. The hand tool with a latch structure according to claim 1, wherein the main body (10) and the rod body (21) are detachably coupled to one another.

* * * * *